US009026029B2

(12) United States Patent
Furuyama

(10) Patent No.: US 9,026,029 B2
(45) Date of Patent: May 5, 2015

(54) SHEET CONVEYANCE APPARATUS AND IMAGE FORMING APPARATUS

(71) Applicant: Canon Kabushiki Kaisha, Tokyo (JP)

(72) Inventor: Yoichi Furuyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/149,673

(22) Filed: Jan. 7, 2014

(65) Prior Publication Data

US 2014/0193186 A1 Jul. 10, 2014

(30) Foreign Application Priority Data

Jan. 10, 2013 (JP) ..... 2013-002696

(51) Int. Cl.

| | |
|---|---|
| ***B65H 7/10*** | (2006.01) |
| ***B65H 7/08*** | (2006.01) |
| ***B65H 9/00*** | (2006.01) |
| ***G03G 15/00*** | (2006.01) |
| ***B65H 9/10*** | (2006.01) |

(52) U.S. Cl.

CPC ..... *B65H 9/002* (2013.01); *G03G 15/6567* (2013.01); *G03G 15/6561* (2013.01); *G03G 15/657* (2013.01); *B65H 7/10* (2013.01); *B65H 9/106* (2013.01); *B65H 2404/1521* (2013.01)

(58) Field of Classification Search

CPC ..... G03G 15/6561; G03G 15/6567; G03G 2215/00561; B41J 11/0055; B41J 13/32; B65H 7/10; B65H 2301/331; B65H 2301/3621; B65H 2601/272; B65H 9/002

USPC ..... 399/388

See application file for complete search history.

(56) References Cited

U.S. PATENT DOCUMENTS

| | | | | |
|---|---|---|---|---|
| 4,855,607 | A * | 8/1989 | Eckl | 250/557 |
| 5,034,781 | A * | 7/1991 | Watanabe | 399/395 |
| 6,647,884 | B1 * | 11/2003 | La Vos et al. | 101/485 |

FOREIGN PATENT DOCUMENTS

JP 6-266181 A 9/1994

* cited by examiner

*Primary Examiner* — Matthew G Marini
*Assistant Examiner* — Justin Olamit
(74) *Attorney, Agent, or Firm* — Canon USA Inc. IP Division

(57) ABSTRACT

A sheet conveyance apparatus includes a sheet conveyance unit configured to convey a sheet, a transfer unit disposed downstream of the sheet conveyance unit and configured to transfer a toner image onto the sheet, a shifting unit configured to shift the sheet conveyed by the sheet conveyance unit in a width direction by shifting the sheet conveyance unit, a detection unit configured to detect a position of the sheet in the width direction while the sheet is being conveyed by the transfer unit, and a control unit configured to control the shifting unit. The control unit causes the sheet conveyed by the sheet conveyance unit to shift in the width direction based on a result detected by the detection unit while the sheet is being conveyed by the transfer unit.

16 Claims, 19 Drawing Sheets

SHEET CONVEYANCE APPARATUS AND IMAGE FORMING APPARATUS

BACKGROUND OF THE INVENTION

1. Field of the Invention

The present invention relates to a sheet conveyance apparatus and an image forming apparatus including the sheet conveyance apparatus.

2. Description of the Related Art

In a conventional image forming apparatus such as an electrophotographic copying machine, a toner image formed on a photosensitive member or an intermediate transfer belt is transferred by a transfer roller onto a sheet conveyed by a registration roller. Then, the transferred toner image is fixed on the sheet by a fixing roller.

During the image forming process in which the sheet passes through the registration roller, the transfer roller, and the fixing roller, the sheet is nipped by the registration roller and the transfer roller, or nipped by all of the registration roller, the transfer roller, and the fixing roller.

In the actual image forming apparatus, there is a case where a misalignment or a pressure imbalance occurs among the registration roller, the transfer roller, and the fixing roller. In such a case, the sheet onto which a toner image is being transferred by the transfer roller may not be conveyed straight ahead. The sheet may become skewed or be conveyed in a skewed state. As a result, the position of the image transferred onto the sheet may deviate.

As a technique for preventing the positional deviation of the image with respect to the sheet, Japanese Patent Application Laid-Open No. 6-266181 discusses an adjustment device capable of adjusting the right and left heights of a conveyance guide.

However, with the configuration of the image forming apparatus discussed in Japanese Patent Application Laid-Open No. 6-266181, adjustment of the conveyance guide has to be performed by a user, and thus there has been a problem that the usability thereof is not good. Further, it may not be possible to prevent the positional deviation of the image with respect to each individual sheet.

There is an increasing demand for recent image forming apparatuses to further improve the usability and the image quality. Thus, it has been desired to improve the technique discussed in Japanese Patent Application Laid-Open No. 6-266181.

SUMMARY OF THE INVENTION

The present invention is directed to a technique for correcting the position of an image to be formed on a sheet with high precision and stabilizing the position of the image formed on the sheet without lowering usability.

According to an aspect of the present invention, a sheet conveyance apparatus includes a sheet conveyance unit configured to convey a sheet, a transfer unit disposed downstream of the sheet conveyance unit and configured to transfer a toner image onto the sheet conveyed thereto, a shifting unit configured to shift a width direction position of the sheet conveyed by the sheet conveyance unit by shifting the sheet conveyance unit, a detection unit configured to detect a width direction position of the sheet being conveyed by the transfer unit, and a control unit configured to control the shifting unit based on a result detected by the detection unit while the sheet is being conveyed by the transfer unit.

Further features of the present invention will become apparent from the following description of exemplary embodiments with reference to the attached drawings.

DESCRIPTION OF THE EMBODIMENTS (General Configuration of Image Forming Apparatus)

Various exemplary embodiments, features, and aspects of the invention will be described in detail below with reference to the drawings.

Figure 10:
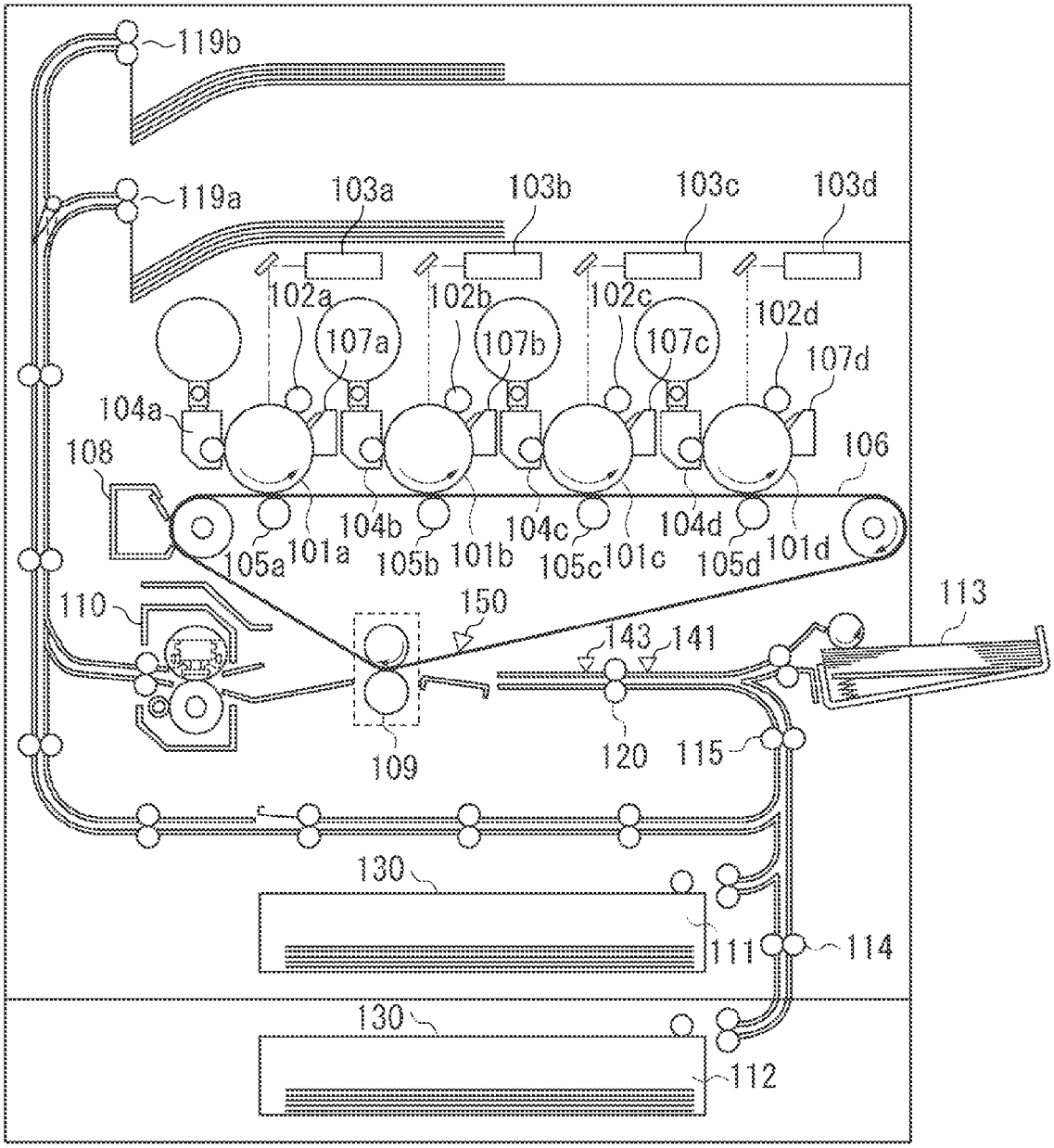
FIG. 10 is a front view illustrating a general configuration of an image forming apparatus according to the first exemplary embodiment.

FIG. 10 is a schematic cross-sectional view of a color digital printer as an example of the image forming apparatus according to the first exemplary embodiment of the present invention.

First, an image forming unit will be described. The surfaces of four photosensitive drums 101*a*, 101*b*, 101*c*, and 101*d* are uniformly charged with electric charge by charging rollers 102*a*, 102*b*, 102*c*, and 102*d*, respectively. Image signals of yellow (Y), magenta (M), cyan (C), and black (K) are input to laser scanners 103*a*, 103*b*, 103*c*, and 103*d*, respectively. According to the respective image signals, the surfaces of the photosensitive drums 101*a*, 101*b*, 101*c*, and 101*d* are irradiated with laser beams, so that the electric charge is neutralized to form latent images thereon.

Development units 104*a*, 104*b*, 104*c*, and 104*d* develop the latent images formed on the photosensitive drums 101*a*, 101*b*, 101*c*, and 101*d* with toner of Y, M, C, and K, respectively. A toner image developed on each of the photosensitive drums 101*a*, 101*b*, 101*c*, and 101*d* is sequentially transferred onto an intermediate transfer belt 106, which is an endless belt-shaped image bearing member, by primary transfer rollers 105*a*, 105*b*, 105*c*, and 105*d*, respectively, so that a full-color toner image is formed on the intermediate transfer belt 106.

A sheet fed from a sheet feeding unit of a feeding cassette 111 or 112 is conveyed to a registration roller pair 120 by a conveyance roller pair 114 and a conveyance roller pair 115. A sheet fed from a manual feeding unit 113 is also conveyed to the registration roller pair 120. Transfer of the toner image formed on the intermediate transfer belt 106 is controlled so that the toner image is transferred onto a correct position on the sheet conveyed by the registration roller pair 120. The toner image is transferred onto the sheet by a secondary transfer outer roller 109 while the sheet is being nipped and conveyed by a transfer nip portion formed of the intermediate transfer belt 106 and the secondary transfer outer roller 109.

The toner image transferred onto the sheet is heated and pressed by a fixing unit 110 so as to be fixed on the sheet while the sheet is being nipped and conveyed by a fixing nip portion of the fixing unit 110. Then, the sheet is discharged from a discharge unit 119*a* or 119*b* to the outside of the main body of the image forming apparatus.

In addition, a user can input various kinds of information relating to the sheet, such as size information, grammage information, and surface property information, to a control unit (described below) through an operation unit 200 (see FIG. 6) disposed on the image forming apparatus. Further, various kinds of information relating to the sheet can be input to the below-described control unit from a computer 201 that is connected thereto via a network.

On each of the feeding cassettes 111 and 112, a size detection unit 130 for detecting the size of a sheet stored therein is disposed in order to cause the below-described control unit of the image forming apparatus to recognize the size of the sheet. The size detection unit 130 includes a size detection lever that is in sliding contact with a side regulating plate to operate therewith. The side regulating plate regulates the position of the sheet in the width direction (the direction orthogonal to the conveyance direction). The side regulating plate is movable in accordance with the side end portion of the sheet, so that the position of the sheet in the width direction can be adjusted with respect to the image forming unit.

On a mounting portion of the main body of the apparatus where the feeding cassette 111 or 112 is to be mounted, there is a plurality of sensors or switches for the size detection unit 130, which is disposed in a position corresponding to the position of the size detection lever. When the side regulating plate is moved in accordance with the side end portion of the sheet, the size detection lever operates with the side regulating plate to rotate. When the feeding cassette 111 or 112 is mounted on the image forming apparatus, the size detection lever selectively turns on or off the sensing elements of the sensors or switches disposed on the mounting portion of the main body of the apparatus. Through the above operation, a signal in a different pattern is transmitted to the main body of the apparatus from the sensors or the switches. Then, based on the signal, the main body of the apparatus can recognize the size of the sheet stored in the feeding cassette 111 or 112. As a size detection unit, a similar unit to the above-described unit may be disposed on the manual feeding unit 113.

The side regulating plate has a function of preventing the skew or lateral misregistration of a sheet from occurring when the sheet is fed. However, in practice, if there is a slight gap between the side regulating plate and the sheet, the skew and lateral misregistration of the sheet may occur. Here, the lateral misregistration refers to a positional deviation in the width direction.

Therefore, the sheet fed from the sheet feeding unit may be skewed or the position of the sheet may deviate in the width direction while the sheet is being conveyed. Thus, the image forming apparatus according to the present exemplary embodiment causes a leading end of the conveyed sheet to come into contact with a nip portion of the registration roller pair 120, which has stopped rotating, and forms a loop in the sheet, so that the skew of the sheet is corrected. At this time, the amount of the loop formed in the sheet needs to be enough to ensure that the leading end of the sheet is placed along the nip portion of the registration roller pair 120. The sheet detected by a registration sensor 141 is conveyed a predetermined amount by the conveyance roller pair 115 disposed upstream of the registration roller pair 120, so that a loop is formed in the sheet.

Further, a first CIS 143 for detecting the position of the sheet in the width direction is disposed between the registration roller pair 120 and the secondary transfer outer roller 109. The sheet is conveyed when the stopped registration roller pair 120 starts rotating again, so that the side end position of the sheet is detected by the first CIS 143. A control unit 250 (see FIG. 6) calculates the amount of deviation between the side end position of the sheet detected by the first CIS 143 and the normal position as a positional deviation correction amount. Then, a width direction shifting unit 300 (see FIG. 1), which serves as a shifting unit for shifting the conveyed sheet in the width direction, shifts the registration roller pair 120 in the width direction (i.e., thrust direction) by the above-described positional deviation correction amount so as to correct the position of the sheet in the width direction. Through the above operation, the position of the sheet in the width direction is corrected before the sheet reaches the secondary transfer outer roller 109. Here, the normal position refers to an end position of the sheet that serves as a reference position for forming an image on the sheet. The normal position is stored in a storage unit such as a read only memory (ROM) included in the image forming apparatus.

In the first exemplary embodiment, a second CIS 150 is disposed downstream of the first CIS 143. Then, based on a result detected by the second CIS 150, the control unit 250 controls the width direction shifting unit 300 to correct the position of the sheet onto which an image is being transferred. The above configuration will be described in detail below.

Figure 1:
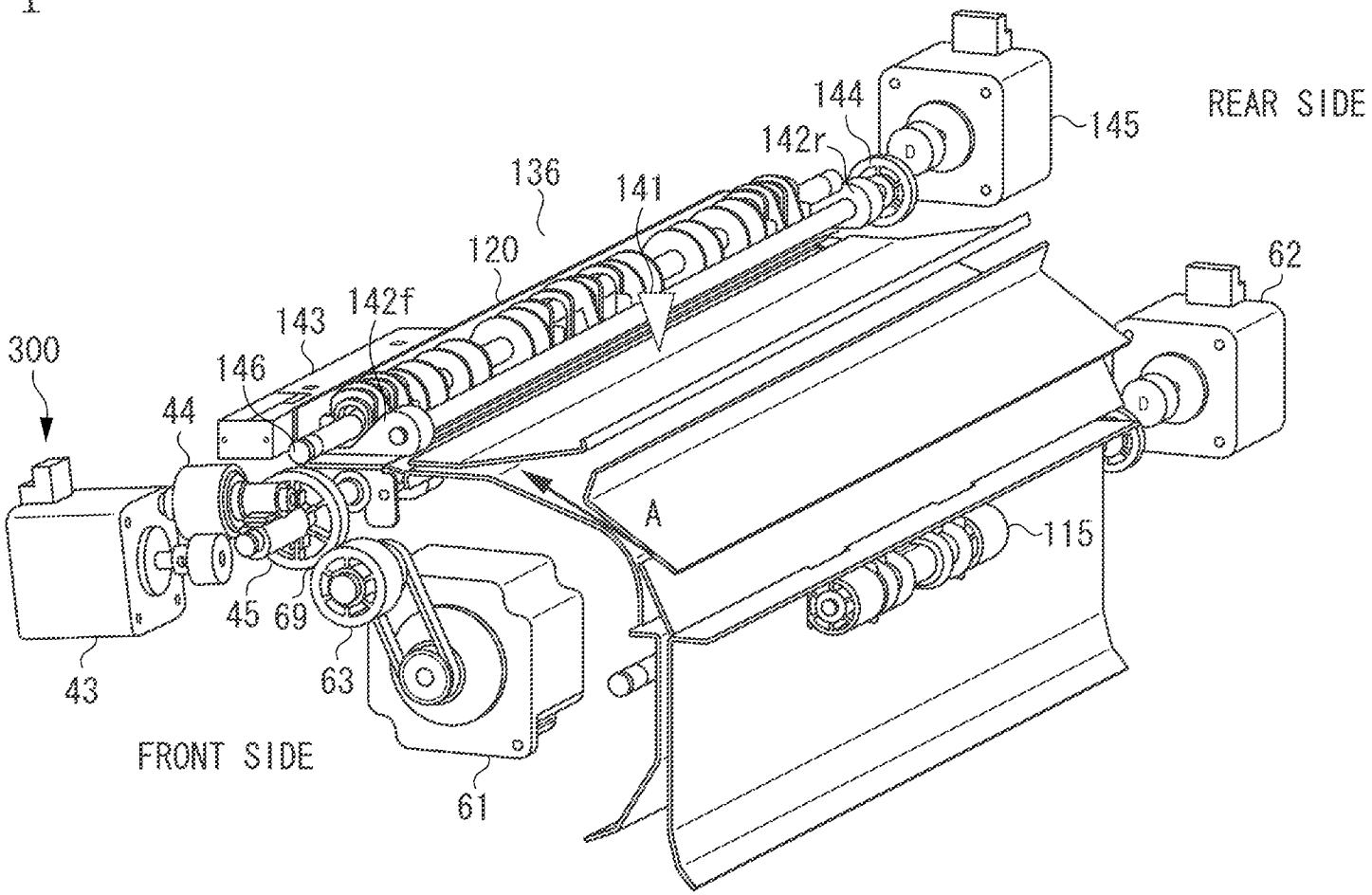
FIG. 1 is a perspective view illustrating a sheet conveyance apparatus according to a first exemplary embodiment of the present invention.

Next, a configuration of a sheet conveyance apparatus 136 according to the first exemplary embodiment will be described in detail with reference to FIG. 1. FIG. 1 is a perspective view illustrating the sheet conveyance apparatus 136 for adjusting the position of the conveyed sheet, which is disposed in the middle of a sheet conveyance path for connecting the feeding cassettes 111 and 112 to the image forming unit.

The conveyance roller pair 115 disposed on the sheet conveyance path includes an upper roller having a polyacetal (POM) roller, and a lower roller which is disposed opposite to the upper roller and is formed of a rubber roller. Then, the upper roller is supported by a lever to be capable of swinging, and is pressed against the lower roller with an elastic force of a spring (not illustrated).

The registration roller pair 120 disposed downstream of the conveyance roller pair 115 includes an upper roller and a lower roller. The registration roller pair 120 serves as a contact portion where the leading end of the conveyed sheet comes into contact therewith in order to correct the skew of the sheet. The sheet is made contact with the nip portion between the upper roller and the lower roller such that the leading end of the sheet is placed along the nip portion, so that the skew of the sheet is corrected. The upper roller of the registration roller pair 120 includes a polyacetal (POM) roller, whereas the lower roller is formed of a rubber roller. The upper roller and the lower roller are disposed opposite to each other. Further, the upper roller is supported by a lever to be capable of swinging, and is pressed against the lower roller with an elastic force of a spring (not illustrated).

In addition, in FIG. 1, a conveyance roller drive motor 62, which serves as a conveyance roller driving unit, rotationally drives the lower roller of the conveyance roller pair 115. A registration roller drive motor 61, which serves as a registration roller driving unit, rotationally drives the lower roller of the registration roller pair 120.

An upper guide and a lower guide for guiding the conveyed sheet are disposed between the conveyance roller pair 115 and the registration roller pair 120. A part of the space between the upper guide and the lower guide is wider in order to allow a loop formed in the sheet that is placed against the nip portion of the registration roller pair 120.

Next, the width direction shifting unit 300 will be described. The width direction shifting unit 300 serves as a shifting unit which shifts the registration roller pair 120 in the width direction to cause the sheet nipped by the registration roller pair 120 to shift in the width direction.

The lower roller of the registration roller pair 120 is fixed to a registration roller rotation shaft, and the registration roller rotation shaft is held by the main body of the apparatus so as to be capable of moving in the sheet width direction. As the registration roller rotation shaft moves in the sheet width direction, the upper roller and the lower roller integrally move in the sheet width direction. A pinion gear 44 is rotated with a driving force from a shift motor 43, so as to cause a rack 45 to move in a translational manner. The rack 45 is rotatable in the rotation direction of the registration roller rotation shaft, and is fixed and supported in the thrust direction. The above configuration enables the registration roller pair 120 to make a thrust movement to shift the sheet nipped by the registration roller pair 120. The face width of a registration roller idler gear 63 is wider than that of a registration roller input gear 69. This enables the registration roller pair 120 to rotate while maintaining the engagement of the gears even if the registration roller pair 120 and the registration roller input gear 69 make a thrust movement.

The amount of positional deviation in the width direction is detected by the first CIS 143. The first CIS 143 is disposed in a position shifted from the center in the sheet width direction. This is because the first CIS 143 can sufficiently detect the amount of positional deviation by detecting only the position of one side end of the conveyed sheet.

Figure 6:
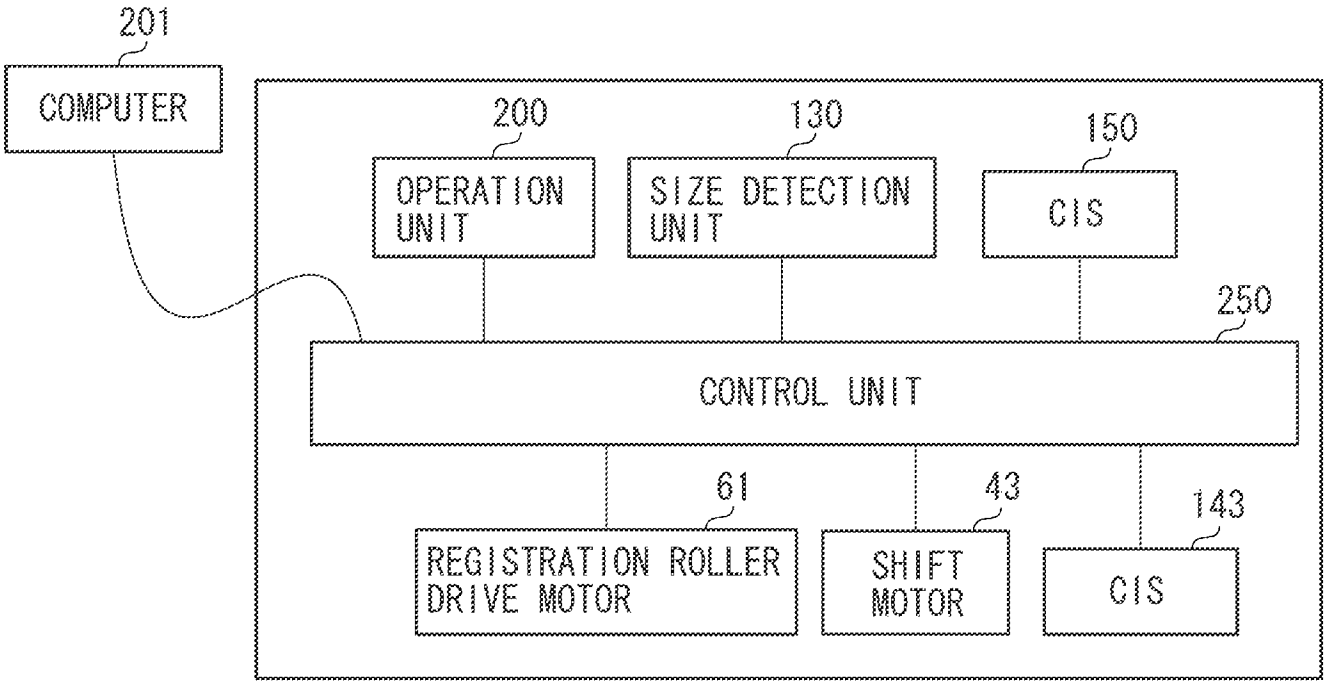
FIG. 6 is a block diagram according to the first exemplary embodiment.

FIG. 6 is a block diagram according to the first exemplary embodiment. The control unit 250 is connected to the operation unit 200 of the image forming apparatus. Further, the control unit 250 is connected to the registration roller drive motor 61, the shift motor 43, the first CIS 143, and the second CIS 150.

With reference to FIG. 1, separation levers 142*f* and 142*r* move up the upper roller of the registration roller pair 120 to perform a separating operation of the registration roller pair 120. The separation levers 142*f* and 142*r* are respectively fixed to two portions of a registration roller separation shaft 146, and a separation drive input gear 144 is fixed to one side end of the shaft. The registration roller separation shaft 146 is rotationally driven by the rotation of a separation motor 145 in the clockwise direction viewed from the front side of the image forming apparatus, so that the separation levers 142*f* and 142*r* are rotated in the counterclockwise direction by a predetermined amount to perform the separating operation. On the other hand, when the upper roller of the registration roller pair 120 is pressed against the lower roller, the separation motor 145 is rotated in a direction opposite to the rotation direction in the separating operation, so that the contact between the separation levers 142*f* and 142*r* and the registration roller separation shaft 146 is released to complete a pressing operation.

Next, a configuration and an operation unique to the first exemplary embodiment will be described.

As described above, the sheet on which an image is to be formed is conveyed by the registration roller pair 120, the secondary transfer outer roller 109, and the fixing unit 110 in this order. The position of the image formed on the sheet depends on the conveyance accuracy of the sheet on the secondary transfer outer roller 109, which transfers the toner image onto the sheet. If the sheet placed on the secondary transfer outer roller 109 becomes skewed or moves in a skewed state instead of moving straight ahead, the image that is transferred onto the sheet may be distorted, or the image may be transferred onto a position deviating from the original position where the image is to be transferred.

A misalignment or a pressure imbalance among the registration roller pair 120, the secondary transfer outer roller 109, and the fixing unit 110 may be considered as a cause of skewing the sheet on the secondary transfer outer roller 109.

Next, the position of the image formed on the sheet when the sheet is conveyed through the registration roller pair 120, the secondary transfer outer roller 109, and the fixing unit 110 will be described with reference to FIGS. 2, 3, 4A, 4B, 4C, and 5. In FIGS. 4A, 4B, 4C and 5, in order to make the technical scope of the present invention easily understood, skewed states of the sheet and the respective rollers are illustrated in an exaggerated manner. However, in the actual exemplary embodiment, the sheet and the respective rollers will not be skewed that much.

Figure 2:
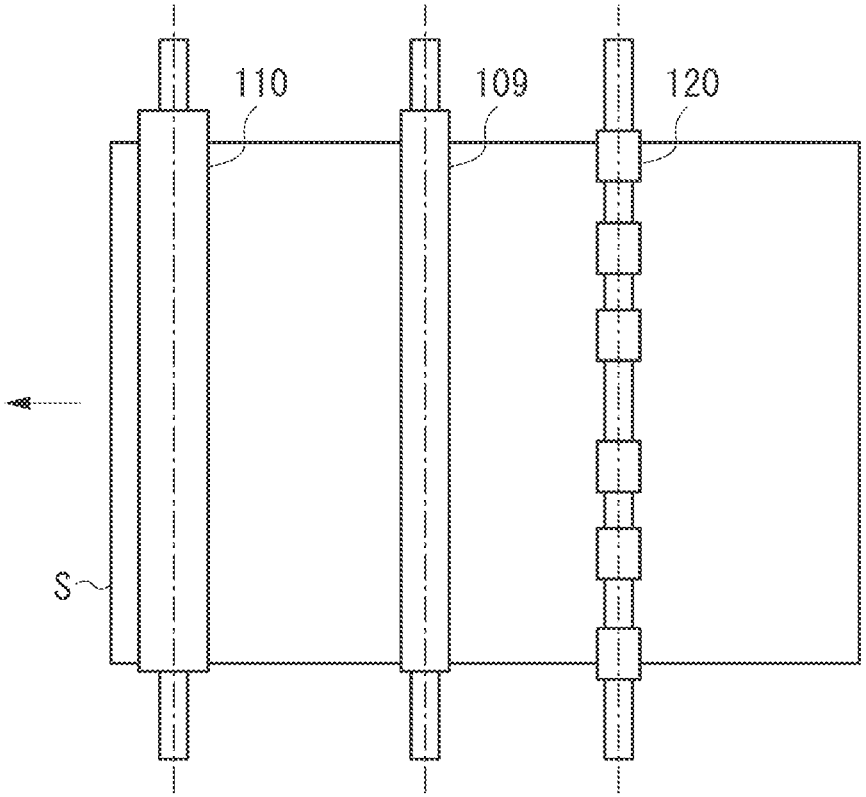
FIG. 2 is a top plan view illustrating the sheet conveyance apparatus according to the first exemplary embodiment.
Figure 3:
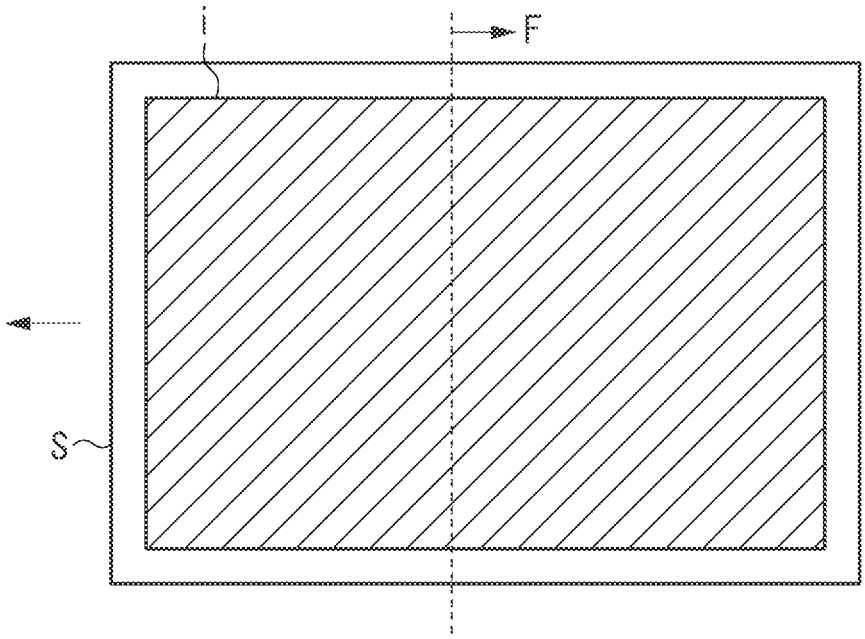
FIG. 3 is a schematic view illustrating a position of an image formed on a sheet.

FIGS. 2, 4A, 4B, and 4C are schematic diagrams of the sheet conveyance path viewed from above the image forming apparatus. As illustrated in FIG. 2, when the registration roller pair 120, the secondary transfer outer roller 109, and the fixing unit 110 are in a correct alignment, a sheet S passes straight through the secondary transfer outer roller 109 and the fixing unit 110. As a result, as illustrated in FIG. 3, an image i is formed in the normal position on the sheet S without distortion. The position indicated by "F" in FIG. 3 is the position of the secondary transfer outer roller 109 when the leading end of the sheet S enters the fixing unit 110.

Figure 4A:
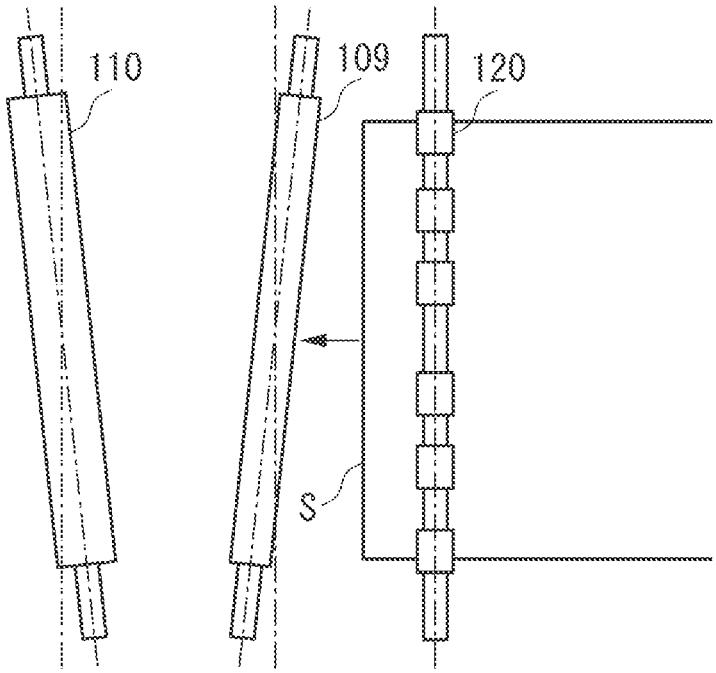
FIGS. 4A, 4B, and 4C are top plan views illustrating a sheet that is being conveyed.
Figure 4B:
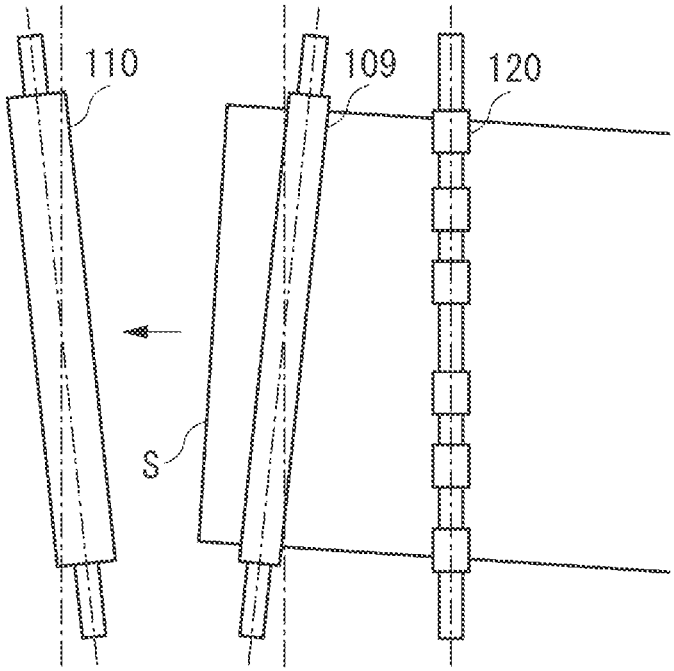
Figure 4C:
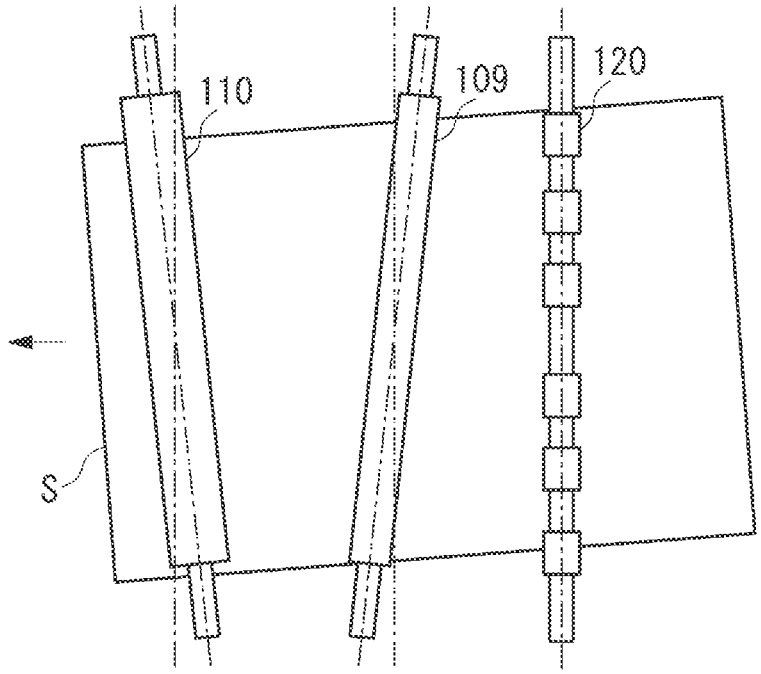
Figure 5:
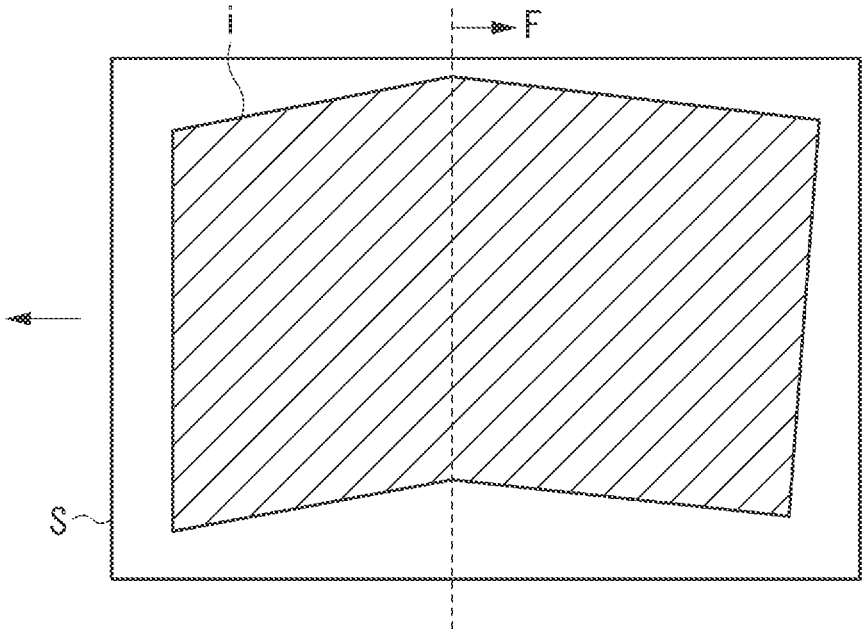
FIG. 5 is a schematic view illustrating a position of an image formed on a sheet.

On the other hand, as illustrated in FIGS. 4A, 4B, and 4C, the registration roller pair 120, the secondary transfer outer roller 109, and the fixing unit 110 are in a state of misalignment, the sheet S becomes skewed in the axial line direction of each of the rollers when the leading end of the sheet S enters the secondary transfer outer roller 109 and the fixing unit 110 (see FIGS. 4B and 4C). As a result, as illustrated in FIG. 5, the position of the image i deviates from the normal position on the sheet S. The travel direction of the sheet S is also affected by a pressure imbalance among the rollers.

As described above, if the registration roller pair 120, the secondary transfer outer roller 109, and the fixing unit 110 are misaligned, the position of the image formed on the sheet may deviate from the normal position. In the present exemplary embodiment, even in the above-described situation, in order to form an image in the normal position on the sheet, the registration roller pair 120 is moved in the width direction while the image is being transferred by the secondary transfer outer roller 109. Specifically, the side end position of the sheet onto which the image is being transferred by the secondary transfer outer roller 109 is detected by the second CIS 150. Then, based on the result detected by the second CIS 150, the control unit 250 controls the driving of the shift motor 43 to shift the registration roller pair 120 in the width direction.

Figure 7:
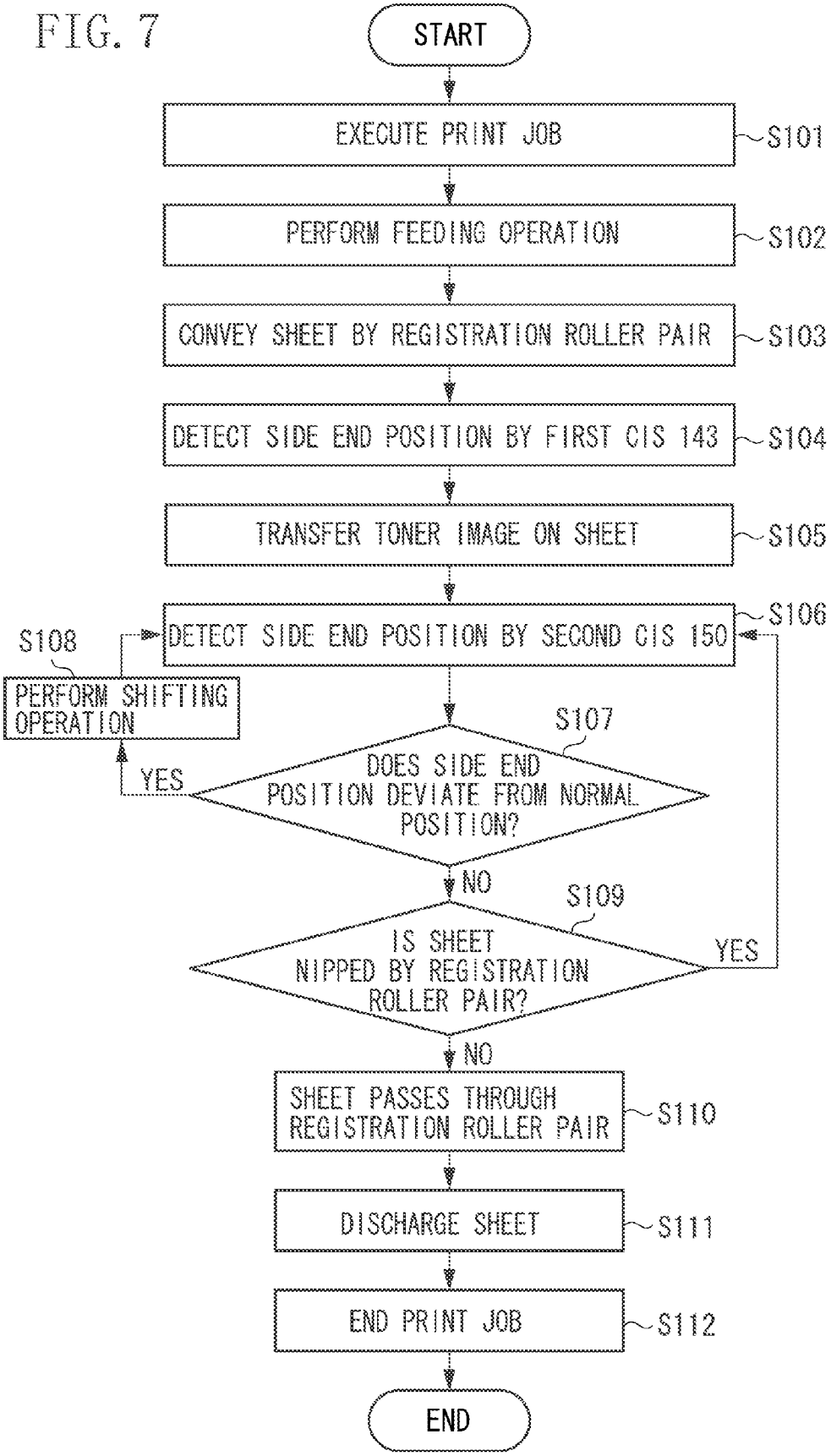
FIG. 7 is a flowchart according to the first exemplary embodiment.

Next, a flow of control processing performed by the control unit 250 will be described with reference to FIG. 7. First, in step S101, a user starts a print job through the operation unit 200 of the image forming apparatus, or through the computer 201 connected to the image forming apparatus directly or via the network.

At this time, in addition to the number of print copies, the user can specify sheet information about the sheet to be used. The sheet information can be detected by the size detection unit 130.

When the print job is executed, in step S102, the control unit 250 performs a sheet feeding operation so that the sheet is conveyed up to the registration roller pair 120 through the conveyance roller pair 115.

In step S103, the sheet in which the skew has been corrected is conveyed by the registration roller pair 120 such that the timing of conveying the sheet is adjusted according to the toner image on the intermediate transfer belt 106.

Figure 8A:
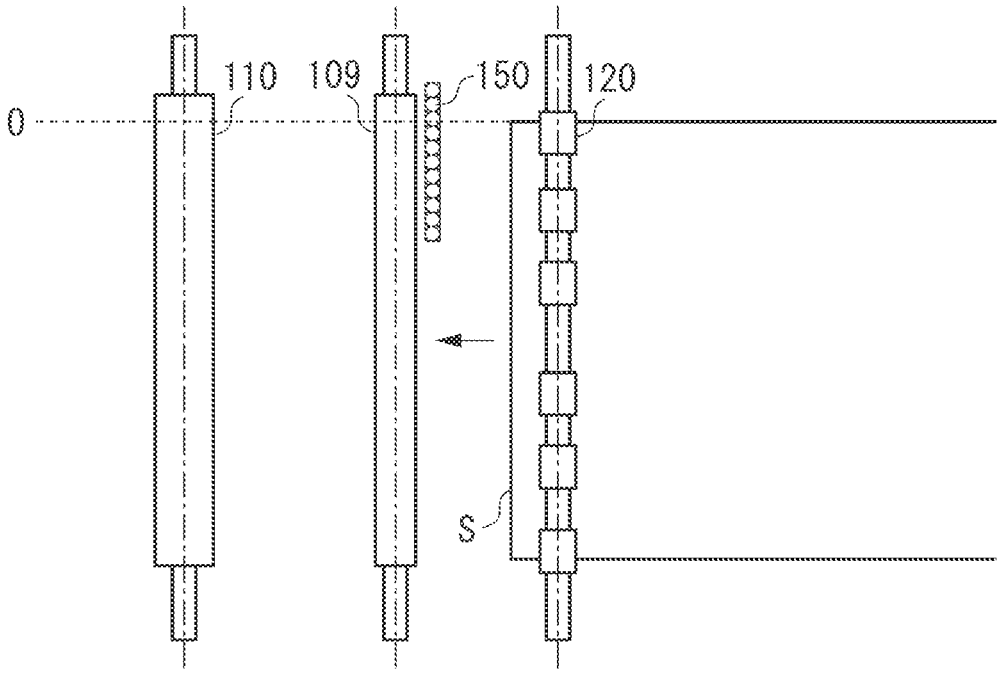
FIGS. 8A, 8B, and 8C are top plan views illustrating a sheet conveying operation performed by the sheet conveyance apparatus according to the first exemplary embodiment.

In step S104, as illustrated in FIG. 8A, the side end position of the sheet conveyed by the registration roller pair 120 is detected by the first CIS 143. Based on the result detected by the first CIS 143, the control unit 250 controls the width direction shifting unit 300 to perform an operation for correcting the position of the sheet in the width direction.

In step S105, the sheet whose position in the width direction has been corrected enters the secondary transfer outer roller 109, so that transfer of the toner image onto the sheet is started. In the present exemplary embodiment, the sheet being conveyed by the secondary transfer outer roller 109 is shifted in the width direction in order to prevent the position of the image transferred onto the sheet from deviating due to a misalignment or a pressure imbalance among the rollers.

Specifically, in step S106, the second CIS 150 detects the side end position of the sheet being conveyed by the secondary transfer outer roller 109. Then, based on the result detected by the second CIS 150, the control unit 250 controls the width direction shifting unit 300. In step S107, if the second CIS 150 detects that the side end position of the sheet deviates from the normal position (YES in step S107), the processing proceeds to step S108. In step S108, the control unit 250 drives the shift motor to shift the registration roller pair 120 by the detected deviation amount.

Figure 8B:
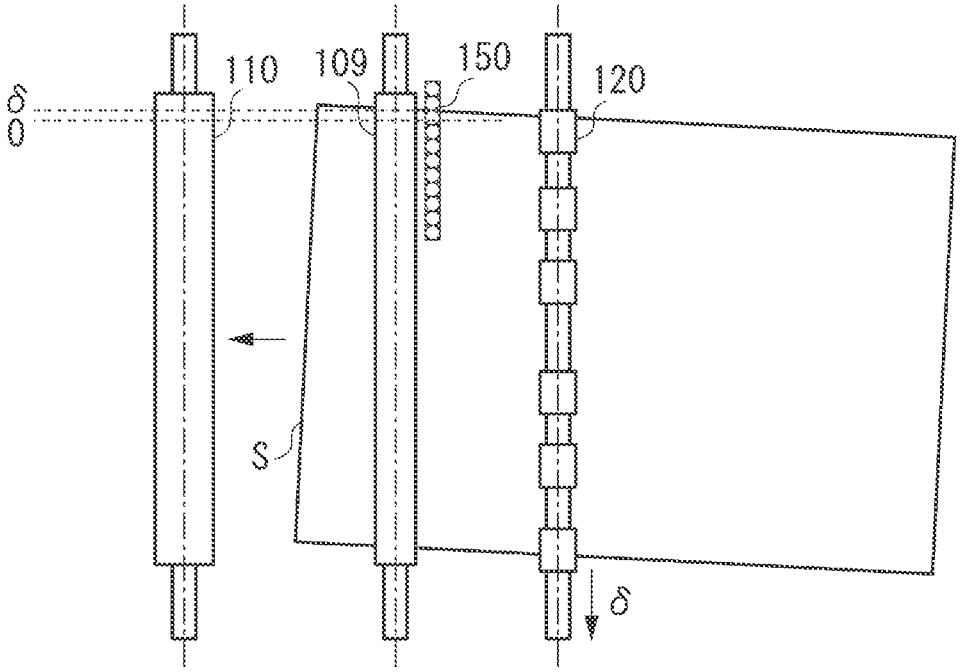
Figure 8C:
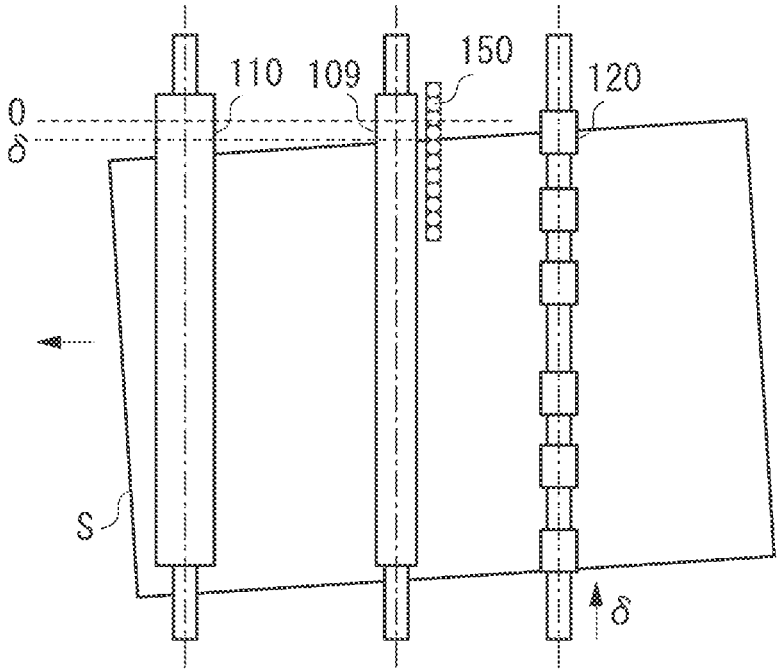

As illustrated in FIGS. 8B and 8C, based on the result detected by the second CIS 150, the control unit 250 calculates a deviation amount $\delta$ from a normal position 0, and drives the shift motor 43 to move the registration roller pair 120 by the deviation amount $\delta$ in a direction opposite to the direction in which the sheet has deviated.

Figure 9:
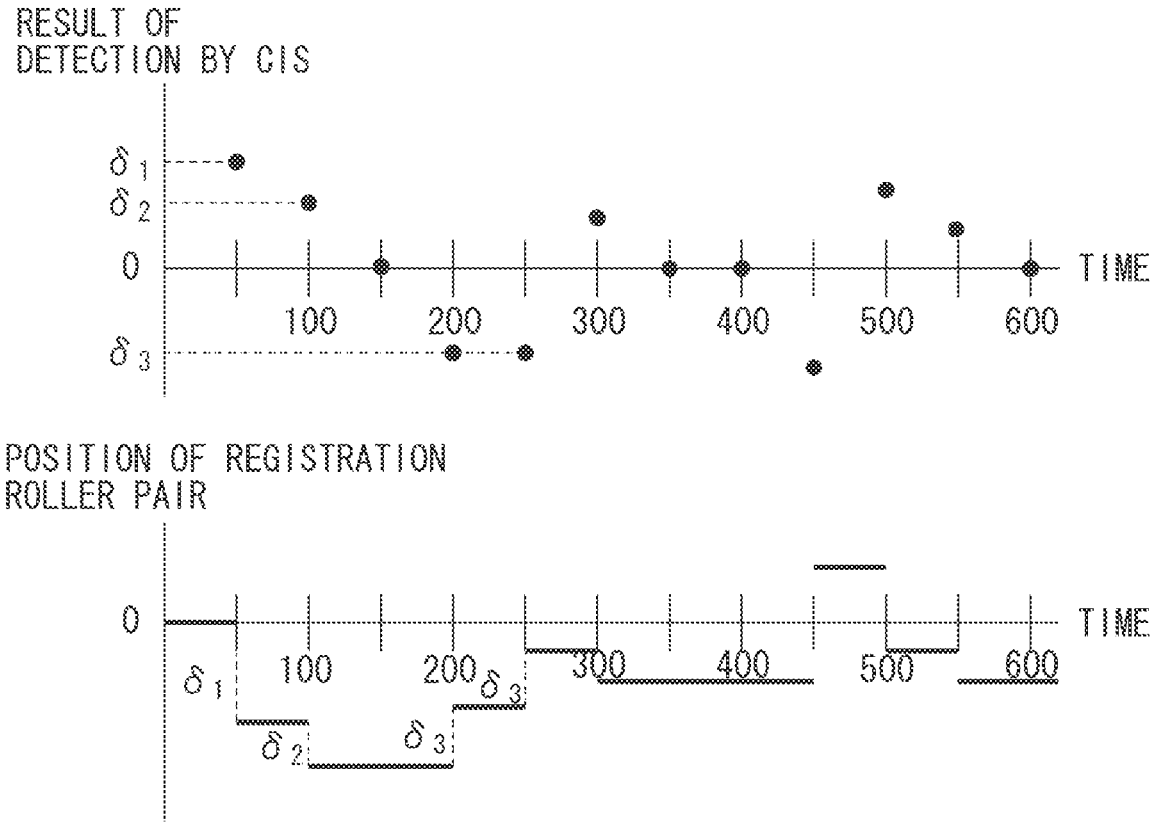
FIG. 9 is a graph illustrating detection results by a second contact image sensor (CIS) and positions of a registration roller pair.

FIG. 9 is a graph illustrating a correspondence relationship between a result of detection by the second CIS 150 and a position of the registration roller pair 120 in the width direction which has been moved based on the result of detection by the second CIS 150. In FIG. 9, the horizontal axes represent elapsed time, whereas the vertical axes respectively represent the detection results by the second CIS 150 and the positions of the registration roller pair 120. The point 0 on each of the horizontal axes represents the time when the leading end of the sheet has passed the second CIS 150, whereas the point 0 on each of the vertical axes represents the detection result by the second CIS 150 at the time, i.e., the normal position.

FIG. 9 will be described below. In the example of FIG. 9, the result detected by the second CIS 150 50 ms after the leading end of the sheet has passed the second CIS 150 indicates that the sheet has deviated from the normal position by a deviation amount $\delta_1$. The control unit 250 therefore shifts the registration roller pair 120 in the opposite direction by the deviation amount $\delta_1$.

In the first exemplary embodiment, the maximum amount in a single shifting operation is 1.0 mm, and the registration roller pair 120 can shift by 0.05 mm with one pulse of the shift motor (permanent magnet (PM) motor) 43.

Therefore, a signal of $\delta_1/0.05$ pulses is provided to the shift motor 43 (20 pulses for an operation of shifting 1.0 mm). The shift motor 43 performs acceleration and deceleration control with a starting pulse of 660 pps, and therefore approximately 20 ms is required to perform the operation of shifting 1.0 mm.

Then, the result detected by the second CIS 150 after another 50 ms indicates that the position has deviated from the normal position by a deviation amount $\delta_2$. The control unit 250 therefore shifts the registration roller pair 120 in the opposite direction by the deviation amount $\delta_2$. Through the above operations, the position of the registration roller pair 120 has been shifted from the normal position by the deviation amount of $\delta_1+\delta_2$.

Furthermore, the result detected by the second CIS 150 after yet another 50 ms indicates that the sheet has returned to the normal position. The control unit 250 therefore maintains the previous position without shifting the registration roller pair 120 (the registration roller pair 120 maintains the position shifted by the deviation amount $\delta_1+\delta_2$).

The control unit 250 performs the subsequent operations in a similar manner to the above-described operations, so that the results detected by the second CIS 150 are fed back to the shifting operations of the registration roller pair 120.

In step S109 and step S110, the above-described operations are performed until the rear end of the sheet has passed the registration roller pair 120.

In step S111, the sheet onto which the toner image has been transferred is discharged after the fixing unit 110 fixes the toner image on the sheet. The above-described shifting operations will also be performed while the sheet is passing through the fixing unit 110 until the rear end of the sheet has passed the registration roller pair 120, although the operation depends on the positional relationship among the registration roller pair 120, the secondary transfer outer roller 109, and the fixing unit 110, or on the size of the selected sheet.

As described above, according to the first exemplary embodiment, the position of the sheet onto which a toner image is being transferred by the secondary transfer outer roller 109 is detected by the second CIS 150 disposed near the secondary transfer outer roller 109. Then, based on the result detected by the second CIS 150, the shifting operation of the registration roller pair 120 is controlled, so that the position of the image formed on the sheet can be prevented from deviating from the normal position.

In the first exemplary embodiment, a configuration including the first CIS 143 and the second CIS 150 disposed downstream of the first CIS 143 has been described. With this configuration, the first CIS 143 can detect the position of the sheet before the leading end of the sheet reaches the transfer unit, whereas the second CIS 150 can detect the position of the sheet being conveyed by the transfer unit at the location closer to the transfer unit.

However, the present invention is not limited thereto. The above configuration may include only a single CIS, although the configuration depends on the positional relationship among the registration roller pair, the transfer unit, and the CISs.

Next, a second exemplary embodiment of the present invention will be described. In the second exemplary embodiment, a configuration in which the sheet being conveyed by the transfer unit is moved in the width direction is different from that of the first exemplary embodiment, but the rest of the configurations are the same as those described in the first exemplary embodiment. Therefore, the description thereof will be omitted as appropriate.

In the first exemplary embodiment, the width direction shifting unit 300 shifts the sheet in the width direction. In the second exemplary embodiment, a swivel unit 400 for swiveling the sheet swivels the sheet.

Figure 11:
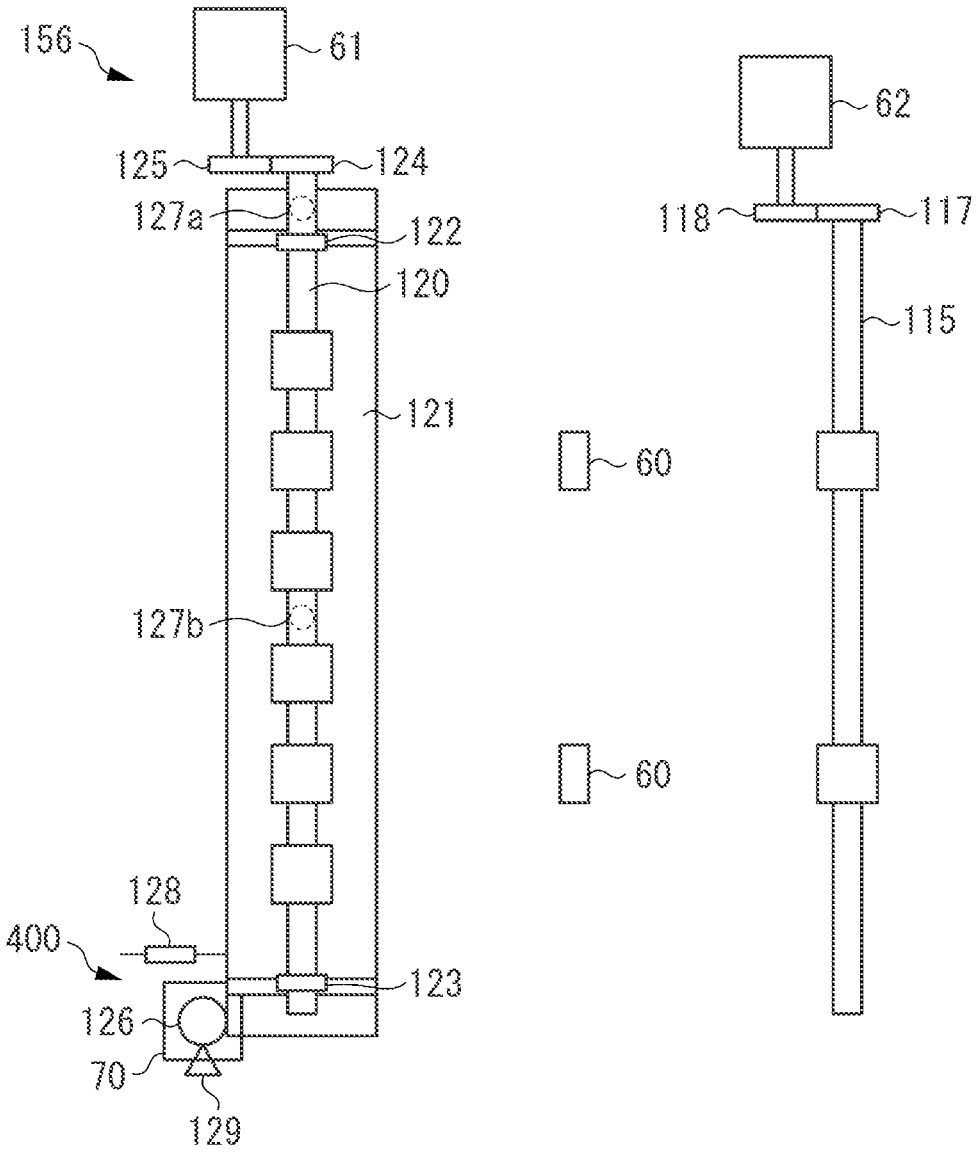
FIG. 11 is a top plan view illustrating a sheet conveyance apparatus according to a second exemplary embodiment of the present invention.
Figure 12:
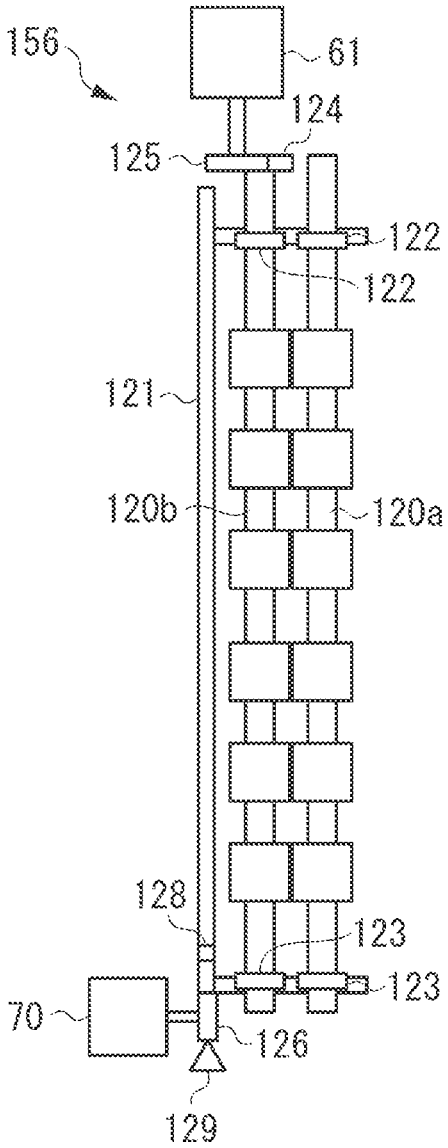
FIG. 12 is a side view illustrating the sheet conveyance apparatus according to the second exemplary embodiment.

Hereinafter, the second exemplary embodiment will be described with reference to FIGS. 11, 12, 13, 14, 15A, 15B, 15C, and 16. FIG. 11 is a diagram illustrating a sheet conveyance apparatus 156 according to the second exemplary embodiment of the present invention. The sheet conveyance apparatus 156 is disposed in the middle of the sheet conveyance path that connects the feeding cassettes 111 and 112 to the image forming unit. FIG. 12 is a diagram illustrating a side view of the sheet conveyance apparatus 156.

The conveyance roller pair 115 disposed on the sheet conveyance path includes an upper roller having a polyacetal (POM) roller, and a lower roller which is disposed opposite to the upper roller and is formed of a rubber roller. The upper roller is pressed against the lower roller with an elastic force of a spring (not illustrated).

A drive input gear 117 is fixed to a shaft end of the lower roller of the conveyance roller pair 115. The drive input gear 117 engages with a gear 118 that is fixed to an output shaft of a drive motor 62, so that the conveyance roller pair 115 can be rotated by driving the drive motor 62.

The registration roller pair 120 disposed downstream of the conveyance roller pair 115 includes an upper roller 120*a* and a lower roller 120*b*. The registration roller pair 120 is capable of swiveling to correct the skew of a sheet. After the leading end of the sheet is nipped by the upper roller 120*a* and the lower roller 120*b*, the registration roller pair 120 swivels to correct the skew of the sheet. The upper roller 120*a* of the registration roller pair 120 includes a polyacetal (POM) roller, whereas the lower roller 120*b* is formed of a rubber roller. The upper roller 120*a* and the lower roller 120*b* are disposed opposite to each other.

The registration roller pair 120 is rotatably supported by shaft bearings 122 and 123 that are fixed to a front side plate and a rear side plate of a frame 121, respectively. The upper roller 120*a* is pressed against the lower roller 120*b* with an elastic force of a spring (not illustrated). A drive input gear 124 is fixed to a shaft end of the lower roller 120*b* of the registration roller pair 120, and engages with a gear 125 that is fixed to an output shaft of the registration roller drive motor 61. Therefore, the registration roller pair 120 can be rotated by driving the registration roller drive motor 61. Further, skew detection sensors 60 for detecting the skew of a sheet in the conveyance direction are disposed upstream of the registration roller pair 120, and are spaced at a predetermined distance in the width direction.

A swivel motor 70 for swiveling the registration roller pair 120 is disposed on the front side of the frame 121, and a cam 126 engages with an output shaft of the swivel motor 70.

The frame 121 is disposed to be capable of swiveling around a rotating shaft 127*b* that is located in an approximately center of the region where a sheet is conveyed. Further, the frame 121 is pressed in the clockwise direction by a spring (elastic member) 128 that is fixed to a side plate (not illustrated) at the left end portion thereof. The configuration may be such that the frame 121 swivels around a rotating shaft 127*a* located at the outside of the region where a sheet is conveyed.

Because the frame 121 comes into contact with the cam 126 on the left front side, rotating the cam 126 allows the frame 121 and all of the members on the frame 121 including the registration roller pair 120 to swivel around the rotating shaft 127*b*. Further, a home position of the registration roller pair 120 can be detected by a home position sensor 129.

Figure 13:
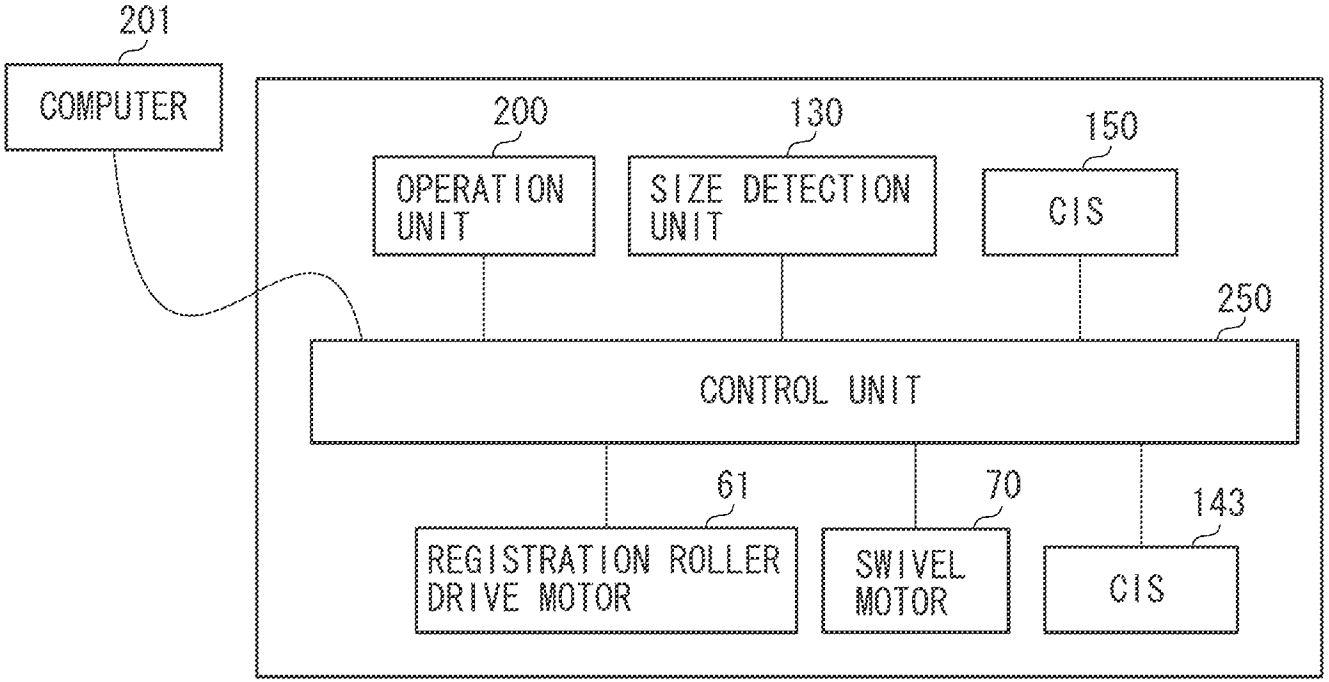
FIG. 13 is a block diagram according to the second exemplary embodiment.

FIG. 13 is a block diagram according to the second exemplary embodiment. In the second exemplary embodiment, the control unit 250 is connected to the swivel motor 70.

Figure 14:
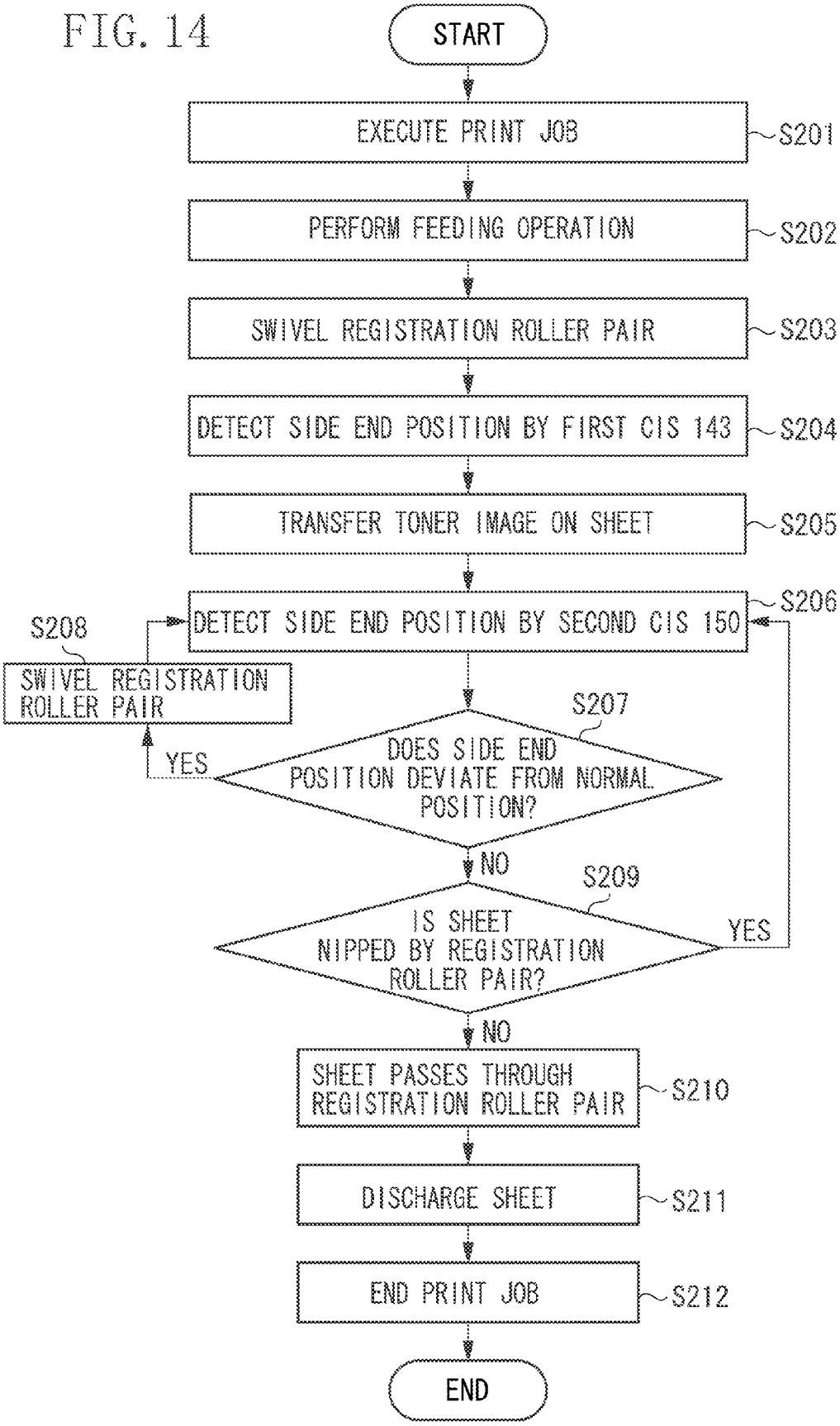
FIG. 14 is a flowchart according to the second exemplary embodiment.

FIG. 14 is a flowchart illustrating a flow of control processing performed by the control unit 250. The second exemplary embodiment is different from the first exemplary embodiment in that the swiveling operation of the registration roller pair 120 is performed in steps S203 and S208, but the processing in the rest of the steps is the same as that described in the first exemplary embodiment. Therefore, the description thereof will be omitted. In the second exemplary embodiment, in step S203, based on the result detected by the skew detection sensor 60, the control unit 250 swivels the registration roller pair 120 to correct the skew of the sheet.

In the second exemplary embodiment, in step S208, if the position of the sheet deviates from the normal position, the control unit 250 drives the swivel motor 70 to swivel the registration roller pair 120.

Figure 15A:
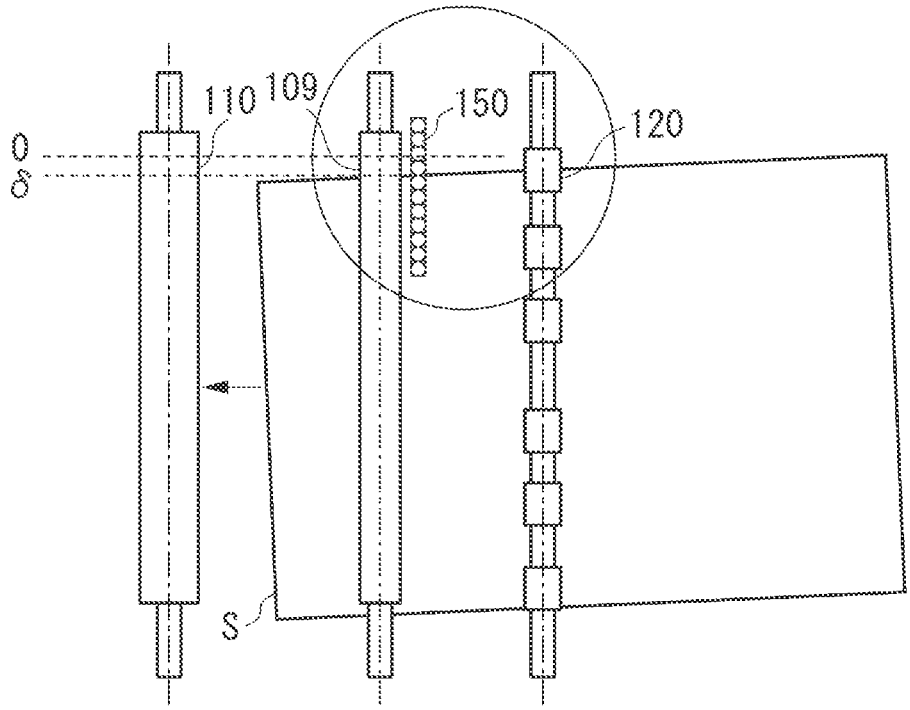
FIGS. 15A, 15B, and 15C are top plan views illustrating a sheet conveying operation performed by the sheet conveyance apparatus according to the second exemplary embodiment.
Figure 15B:
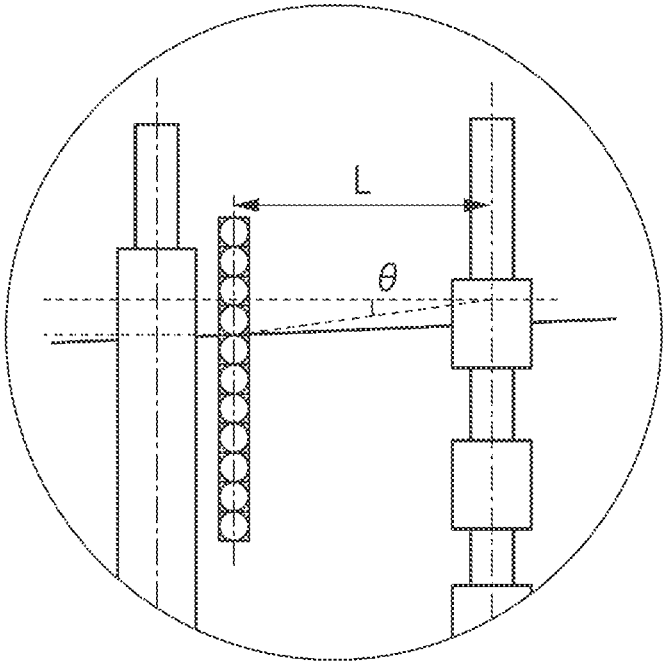
Figure 15C:
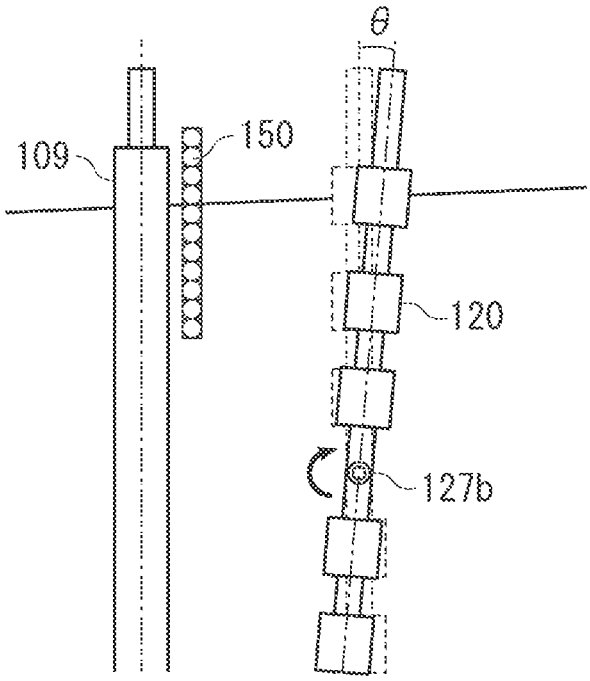

At this time, an angle to swivel the registration roller pair 120 will be obtained as follows. First, as illustrated in FIG. 15A, based on the result detected by the second CIS 150, the control unit 250 calculates the deviation amount $\delta$ from the normal position. As illustrated in FIGS. 15B and 15C, when a distance between the registration roller pair 120 and the second CIS 150 in the conveyance direction is "L", the control unit 250 swivels the registration roller pair 120 by an angle $\theta$ ($\theta=\tan^{-1}(\delta/L)$).

By swiveling the registration roller pair 120, the sheet conveyance direction of the registration roller pair 120 is changed to the direction that corrects the deviation amount detected by the second CIS 150, so that the sheet is placed in the normal position on the second CIS 150.

Figure 16:
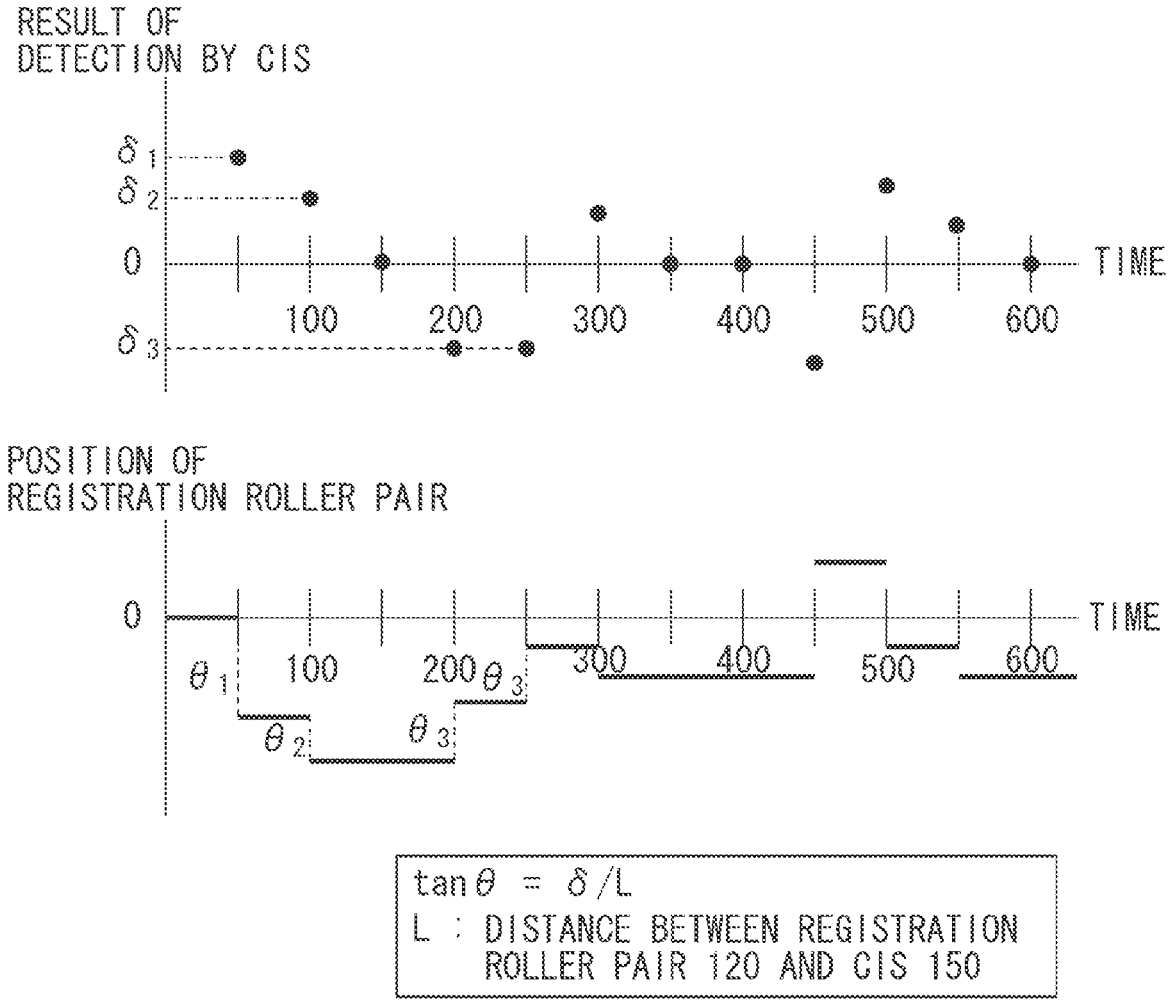
FIG. 16 is a graph illustrating detection results by the second CIS and angles of the registration roller pair.

FIG. 16 is a graph illustrating a correspondence relationship between a result of detection by the second CIS 150 and a position of the registration roller pair 120 in the width direction, which is moved (swiveled) based on the result of detection by the second CIS 150.

In FIG. 16, the horizontal axes represent elapsed time, whereas the vertical axes respectively represent the detection results by the second CIS 150 and the positions of the registration roller pair 120. The point 0 on each of the horizontal axes represents the time when the leading end of the sheet has passed the second CIS 150, whereas the point 0 on each of the vertical axes represents the detection result by the second CIS 150 at the time, i.e., the normal position.

FIG. 16 will be described below. In the example of FIG. 16, the result detected by the second CIS 150 50 ms after the leading end of the sheet has passed the second CIS 150 indicates that the sheet has deviated from the normal position by a deviation amount $\delta_1$. The control unit 250 therefore swivels the registration roller pair 120 in the opposite direction by an angle $\theta_1$ ($\tan\theta_1=\delta_1/L$).

In the second exemplary embodiment, the distance L between the registration roller pair 120 and the second CIS 150 in the conveyance direction is 50 mm, and the maximum amount in a single swiveling operation is 1.2°. More specifically, when the registration roller pair 120 is swiveled by 1.2°, the position in the width direction can be corrected by approximately 1.0 mm ($\delta$=L*tan 1.2°). In the second exemplary embodiment, the configuration is such that the registration roller pair 120 can be swiveled by 0.06° with one pulse of the swivel motor (PM motor) 70.

Therefore, the control unit 250 provides a signal of $\theta_1/0.06$ pulses to the swivel motor 70 (20 pulses for an operation of swiveling 1.2°). The swivel motor 70 performs acceleration and deceleration control with a starting pulse of 660 pps, and therefore approximately 20 ms is required to perform the operation of swiveling 1.2°.

Then, the result detected by the second CIS 150 after another 50 ms indicates that the position has deviated from the normal position by a deviation amount $\delta_2$. The registration roller pair 120 is therefore swiveled in the opposite direction by an angle $\theta_2$. As a result of the above operations, the registration roller pair 120 has been swiveled by the angle $\theta_1+\theta_2$.

Furthermore, the result detected by the second CIS 150 after yet another 50 ms indicates that the sheet has returned to the normal position. The control unit 250 therefore maintains the previous position without swiveling the registration roller pair 120 (the registration roller pair 120 maintains the position swiveled by the angle $\theta_1+\theta_2$).

The control unit 250 performs the subsequent operations in a similar manner to the above-described operations, so that the results detected by the second CIS 150 are fed back to the swiveling operations of the registration roller pair 120.

The processing in the subsequent steps in the flowchart is the same as that described in the first exemplary embodiment, and thus the description thereof will be omitted.

As described above, according to the second exemplary embodiment, the position of the sheet onto which a toner image is being transferred by the secondary transfer outer roller 109 can be adjusted in the width direction by swiveling the registration roller pair 120. This can prevent the position of the image formed on the sheet from deviating from the normal position.

Further, in the first and second exemplary embodiments described above, when the sheet is shifted or swiveled, it is desirable to form a loop in the sheet in a region between the registration roller pair 120 and the secondary transfer outer roller 109. The loop can be formed in the sheet by making the sheet conveyance speed of the registration roller pair 120 faster than that of the secondary transfer outer roller 109.

When the sheet is shifted or swiveled, a reaction force caused by stiffness of the sheet is applied thereon. The reaction force is particularly greater in thick paper, so that greater driving torque is required for the motor because this reactive force will be resistance to the registration roller pair 120 that is to be shifted or swiveled.

In recent image forming apparatuses, in terms of cost and space, it is desirable to employ smaller-size motors. Forming a loop in the sheet allows the deformation of the sheet caused by the shifting or swiveling operation to be absorbed into the loop, and the reaction force of the sheet to be reduced, thereby preventing the driving torque necessary for the motor from being increased.

However, particularly in thin paper, if the amount of the loop formed in the sheet is excessive, the sheet does not follow the registration roller pair 120 even if the shifting or swiveling operation is performed, and only the deformation of the loop in the sheet occurs. As a result, the position of the sheet on the secondary transfer outer roller 109 in the width direction cannot be corrected, and thus a sufficient effect may not be obtained.

Therefore, it is desirable to optimize the amount of the loop formed in the sheet (i.e., the relationship in speed between the registration roller pair 120 and the secondary transfer outer roller 109) according to the distance between the rollers, the relationship in sheet nipping pressure among the rollers, and the type of the sheet.

Further, in the first and second exemplary embodiments described above, the configuration employs a CIS as a unit for detecting the position of a sheet in the width direction. However, the configuration according to the present invention is not limited thereto, and another type of sensor may be employed as the unit.

According to the exemplary embodiments of the present invention, the detection unit detects the width direction position of the sheet being conveyed by the transfer unit, and the sheet conveyance unit is shifted based on the detection result. Thus, the position of the image formed on the sheet can be stabilized without lowering usability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-002696 filed Jan. 10, 2013, which is hereby incorporated by reference herein in its entirety.

What is claimed is:

1. A sheet conveyance apparatus comprising:

a sheet conveyance unit configured to convey a sheet in a sheet conveyance direction;

a transfer unit disposed downstream in the sheet conveyance direction of the sheet conveyance unit and configured to transfer a toner image onto the sheet;

a shifting unit configured to move the sheet conveyed by the sheet conveyance unit in a width direction perpendicular to the sheet conveyance direction by moving the sheet conveyance unit;

a detection unit configured to detect a position of the sheet in the width direction while the sheet is being conveyed by the transfer unit; and a control unit configured to control the shifting unit, wherein the control unit controls the shifting unit to move the sheet conveyance unit in the width direction based on a result detected by the detection unit while the sheet is being conveyed by the transfer unit.

2. The sheet conveyance apparatus according to claim 1, wherein, if the detection unit detects that a position of the sheet being conveyed deviates from a normal position, the control unit controls the shifting unit to move the sheet conveyance unit in the width direction so as to compensate the deviation.

3. The sheet conveyance apparatus according to claim 2, wherein the control unit controls the shifting unit to move the sheet conveyance unit in a direction opposite to a direction of the deviation by an amount of the deviation.

4. The sheet conveyance apparatus according to claim 1, wherein the control unit controls the shifting unit to move the sheet conveyance unit in the width direction based on the result detected by the detection unit before a leading end of the sheet conveyed by the sheet conveyance unit reaches the transfer unit.

5. The sheet conveyance apparatus according to claim 1, wherein the detection unit is disposed downstream of the sheet conveyance unit and upstream of the transfer unit.

6. The sheet conveyance apparatus according to claim 1, wherein the sheet conveyance unit includes a registration roller pair.

7. The sheet conveyance apparatus according to claim 1, wherein the shifting unit includes a width direction shifting unit for shifting the sheet conveyance unit in the width direction.

8. The sheet conveyance apparatus according to claim 1, wherein the shifting unit includes a swivel unit for swiveling the sheet conveyance unit.

9. A sheet conveyance apparatus comprising:

a sheet conveyance unit configured to convey a sheet in a sheet conveyance direction;

a transfer unit disposed downstream in the sheet conveyance direction of the sheet conveyance unit and configured to transfer a toner image onto the sheet;

a shifting unit configured to shift the sheet conveyed by the sheet conveyance unit in a width direction perpendicular to the sheet conveyance direction by shifting the sheet conveyance unit;

a first detection unit configured to detect a position of the sheet in the width direction while the sheet is conveyed by the sheet conveyance unit;

a second detection unit disposed downstream of the first detection unit and configured to detect the position of the sheet in the width direction; and a control unit configured to control the shifting unit, wherein the control unit controls the shifting unit to shift the sheet conveyance unit in the width direction based on a result detected by the first detection unit before a leading end of the sheet conveyed by the sheet conveyance unit reaches the transfer unit, and the control unit controls the shifting unit to shift the sheet conveyance unit in the width direction according to a result detected by the second detection unit while the sheet is being conveyed by the transfer unit.

10. A sheet conveyance apparatus comprising:

a sheet conveyance unit configured to convey a sheet in a sheet conveyance direction;

a transfer unit disposed downstream in the sheet conveyance direction of the sheet conveyance unit and configured to transfer a toner image onto the sheet;

a width direction shifting unit configured to shift the sheet conveyed by the sheet conveyance unit in a width direction perpendicular to the sheet conveyance direction by shifting the sheet conveyance unit in the width direction;

a detection unit configured to detect a position of the sheet in the width direction while the sheet is conveyed by the sheet conveyance unit; and a control unit configured to control the width direction shifting unit, wherein the control unit controls the width direction shifting unit to shift the sheet conveyance unit in the width direction based on a result detected by the detection unit before a leading end of the sheet conveyed by the sheet conveyance unit reaches the transfer unit, and the control unit controls the width direction shifting unit to shift the sheet conveyance unit in the width direction according to the result detected by the detection unit while the sheet is being conveyed by the transfer unit.

11. The sheet conveyance apparatus according to claim 10, wherein, if the detection unit detects that a position of the sheet being conveyed deviates from a normal position, the control unit controls the width direction shifting unit to shift the sheet conveyance unit in the width direction so as to compensate the deviation.

12. The sheet conveyance apparatus according to claim 11, wherein the control unit controls the width direction shifting unit to shift the sheet conveyance unit in a direction opposite to a direction of the deviation by an amount of the deviation.

13. The sheet conveyance apparatus according to claim 10, wherein the detection unit is disposed downstream of the sheet conveyance unit and upstream of the transfer unit.

14. The sheet conveyance apparatus according to claim 10, wherein the sheet conveyance unit includes a registration roller pair.

15. The sheet conveyance apparatus according to claim 10, wherein, before the width direction shifting unit shifts the sheet conveyance unit, the sheet conveyance apparatus forms a loop in the sheet in a region between the transfer unit and the sheet conveyance unit.

16. The sheet conveyance apparatus according to claim 10, further comprising a fixing unit disposed downstream of the transfer unit.

* * * * *